United States Patent [19]

Nagano et al.

[11] 3,933,625

[45] Jan. 20, 1976

[54] ELECTRICAL PRECONDITIONING IN A SELECTIVE FLOTATION OF SULFIDE ORES

[75] Inventors: Ikuo Nagano, Hino; Kozo Saitoh, Tokyo, both of Japan

[73] Assignee: Mitsui Mining & Smelting Co., Ltd., Tokyo, Japan

[22] Filed: Jan. 9, 1974

[21] Appl. No.: 431,926

[30] Foreign Application Priority Data

Nov. 14, 1973 Japan ..... 48-127188

[52] U.S. Cl. ..... 209/9; 209/167

[51] Int. Cl.[2] ..... B03B 1/00

[58] Field of Search ..... 209/166, 9, 167, 162, 164, 209/1, 2, 3, 165, 163; 204/92, 130

[56] References Cited

UNITED STATES PATENTS

| | | | |
|---|---|---|---|
| 554,914 | 2/1896 | Ommick | 209/9 X |
| 1,126,965 | 2/1915 | Emerson | 209/164 |
| 2,084,316 | 7/1936 | Beatty | 209/164 |
| 2,258,507 | 10/1941 | Noag | 209/166 |
| 3,745,102 | 7/1973 | Banerji | 204/92 X |

FOREIGN PATENTS OR APPLICATIONS

| | | | |
|---|---|---|---|
| 398,058 | 3/1921 | Germany | 209/164 |
| 477,950 | 2/1927 | Germany | 209/164 |
| 505,659 | 5/1920 | France | 209/9 |
| 914,067 | 12/1962 | United Kingdom | 209/164 |

OTHER PUBLICATIONS

Chem Abst. 78, 1973, 138984r.

*Primary Examiner*—Robert Halper

*Attorney, Agent, or Firm*—Woodhams, Blanchard and Flynn

[57] ABSTRACT

A flotation method for sulfide ores in which, prior to sulfide ore flotation for effecting a mutual separation of the ore constituents, there is carried out a pretreatment or conditioning step by applying d-c current to the sulfide ore slurry by means of an electrode in order to depress the floatability of certain of the ore constituents.

8 Claims, 6 Drawing Figures

ELECTRICAL PRECONDITIONING IN A SELECTIVE FLOTATION OF SULFIDE ORES

BACKGROUND OF THE INVENTION

1. FIELD OF THE INVENTION

This invention relates to an improved flotation method for sulfide ores.

2. DESCRIPTION OF THE PRIOR ART

In general, when flotation of sulfide ores is carried out to effect mutual separation of ore constituents, a depressing agent is used to depress or inhibit the floatability of a particular constituent or constituents of the ore. A collecting agent, a frothing agent and a condition-regulating agent are used to induce a copious froth. The prior art flotation methods have been dependent on the utilization of these chemical agents or additives.

The mechanisms of the depressing action that occurs during flotation using chemical agents are due to a variety of effects, such as the cleaning effect of the agents on the surfaces of the mineral particles, the selective adsorption or the selective chemical affinity of the depressing agent to the mineral particles, or the change of electric charge on the surfaces of the mineral particles. A unified explanation of the effects caused by these variables is difficult. Therefore, in the flotation method utilizing the depressing action of chemical agents, various depressing agents are selected and used based on the various particular requirements of each process, namely, the kind of ore used and its quality, the kind of collecting agent used, etc. In addition to the treatment with chemical agents, there are other well known depressing methods involving physical treatments, for example, separation of Cu-Zn by heating the pulp, utilization of heating by a furnace, utilization of ultrasonic waves, or aging or heaping and the like.

SUMMARY OF THE INVENTION

We have discovered that a depressing action can be produced by applying d-c current to the sulfide ore slurry in a pre-treatment or conditioning step, prior to flotation, so that an effective mutual separation of the minerals can be obtained by flotation.

An object of this invention is to provide a flotation method for sulfide ores which is suitable for carrying out an effective mutual separation of the constituents of the ore.

Another object of this invention is to provide a flotation method for sulfide ores which facilitates the control of the flotation for separating the constituents of the sulfide ores.

A further object of this invention is to provide a non-polluting flotation method which does not use toxic agents and is economically profitable.

The sulfide ores employed in the present invention include ordinary single sulfides of copper, lead, zinc and iron, as well as ores containing molybdenum, graphite, quartz, calcite, dolomite, etc., and also the products of general flotation of sulfide ores such as the bulk concentrates of straight differential flotations. In the pre-treatment or conditioning step of the method of this invention, d-c current is conducted into an ore slurry using electrodes, so as to produce a depressing action whereby the flotation of certain constituents of the ore is inhibited during the subsequent flotation step.

In the present invention, the conditions for achieving the depression action can be obtained by suitable selection of combinations of electrode materials, d-c voltage, d-c current and electric conditioning agent employed in the conditioning step.

DETAILED DESCRIPTION OF THE INVENTION

The flotation method according to the present invention is capable of achieving wide variations in the flotation properties of the ore slurry by changes of the electrode materials and the electric conditioning time. These will be further described by referring to the accompanying drawings.

In the experiments carried out to obtain the data appearing in the accompanying drawings, the processing agents used were mineral oil and MIBC in the case of molybdenum sulfide ores and pine oil and potassium ethylxanthate in the case of the other sulfide ores. The experimental apparatus used was a conventional laboratory flotation cell having an electrically insulated agitator. The electrodes were inserted in this apparatus, and d-c current was conducted into the slurry for conditioning same prior to the flotation. Then after the addition of the flotation agent, flotation was carried out.

Figure 1:
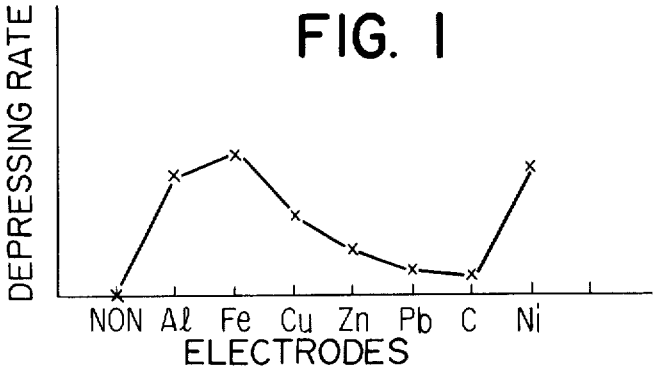
FIG. 1 is a graph showing the effect on the depressing rate caused by various electrode materials when d-c current is applied to the copper sulfide ore slurry by electrodes before flotation of the ore.
Figure 2:
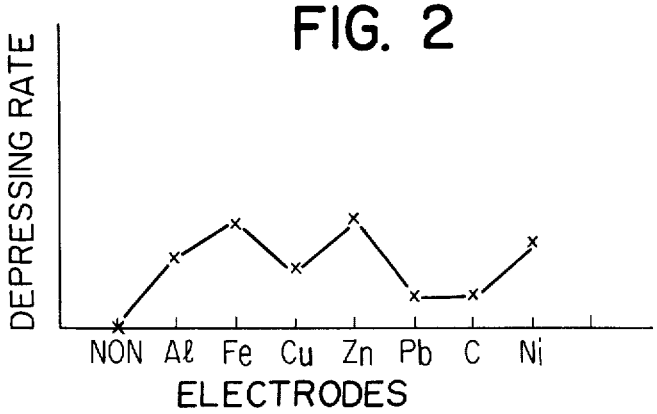
FIG. 2 is a graph showing the effect on the depressing rate caused by various electrode materials when d-c current is applied to the lead sulfide ore slurry before flotation of the ore.
Figure 3:
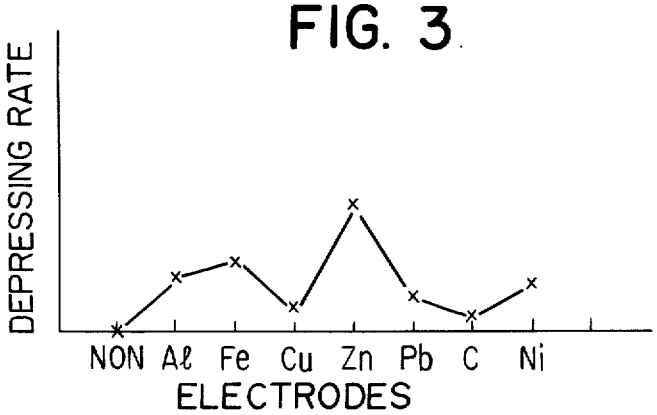
FIG. 3 is a graph showing the effect on the depressing rate caused by various electrode materials when d-c current is applied to the ore slurry before flotation, wherein the ore is zinc sulfide ore which had been previously activated by copper sulfate.
Figure 4:
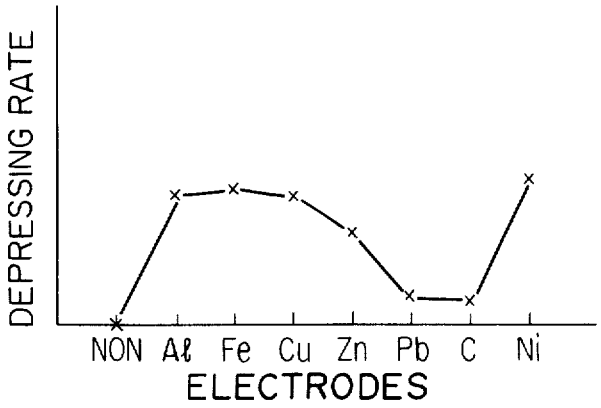
FIG. 4 is a graph showing the effect on the depressing rate caused by various electrode materials when d-c current is applied to the iron sulfide ore slurry before flotation of the ore.
Figure 5:
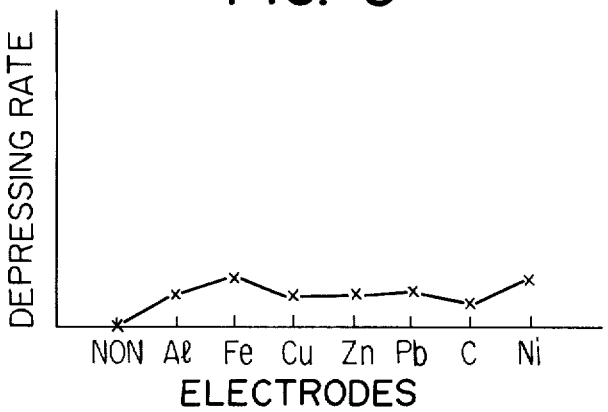
FIG. 5 is a graph showing the effect on the depressing rate caused by various electrode materials when d-c current is applied to the molybdenum sulfide slurry before flotation of the ore.
Figure 6:
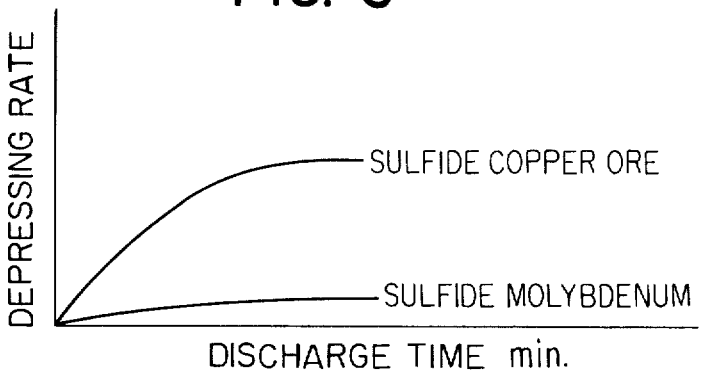
FIG. 6 is a graph showing the effect on the depressing rate caused by the electric conditioning time when d-c current is applied to the ore slurry before the flotation of copper sulfide and molybdenum sulfide ores.

In the experiments of FIGS. 1–5, for the same ore samples, the amount of voltage, current, electric conditions and electric conditioning agent were the same. Only the electrode materials were changed. In the drawings, the abscissa shows the electrode materials that were used. The symbol "non" signifies that no d-c current was applied, i.e., this shows the flotation result when the conditioning pre-treatment of this invention is not applied. The ordinates show the depressing rate caused by the electric conditioning and indicate the relative depressing rate of each electrode material. In each case the value for "non" was taken as being the datum point, i.e., 0percent relative depressing rate. FIGS. 1 through 5 show the effects of the depressing action of the respective electrode materials at a fixed electric conditioning time. This action is also a function of conditioning time as shown in FIG. 6. It can be observed from these drawings that the depressing rate for each sulfide ore varies depending on the electrode material used, respectively. Therefore, it is necessary to select a suitable electrode material for best results with each different sulfide ore. It is desirable to use electrodes which gradually dissolve in use such as Al, Cu, Ni and the like or non-soluble electrodes such as carbon, alone or in combinations thereof. The electrode shape is not critical and can be selected from such shapes as plate, bar, cylinder, lattice or fiber and combinations thereof, depending on the conditions such as the existence of an agitator, the strength of the agitator, the physical properties of the ore slurry or the shape of the conditioning tank. But it is desirable to use a plate type electrode.

The preferred optimum values of electric voltage, electric current and electric conditioning time will vary depending on the particular ore treated. These requirements are related closely to the kind of the electric conditioning agent used and the amount thereof, the distance between electrodes, the areas of said electrodes, and the size of the electric conditioner vessel. There is employed a current density of 0.002 to 20 $A/dm^2$ and a voltage of 0.5 to 750 volts. Suitable values within those ranges can be readily selected, taking the foregoing points into consideration, by carrying out a series of routine experiments to determine the specific conditions that will provide the most economic recovery of a concentrate of the desired mineral.

It is preferred to add to the ore slurry or pulp an electric conditioning agent which acts as a strong electrolyte, in order to minimize the amount of electric power required. But this electric conditioning agent should not be dissociated into ions which interrupt the depressing action. Suitable conditioning agents include hydroxides such as KOH, $Ca(OH)_2$, $Zn(OH)_2$, $NH_4OH$, acids such as $HNO_3$, $H_2SO_4$, HCl, $CH_3COOH$, $H_2C_2O_4$ and salts thereof. The halogenides of the alkali metals or of the alkaline earth metals are preferred.

As stated above, the effective mutual separation of the constituents of sulfide ores can be achieved by suitably selecting the electrode material, the d-c voltage and current and the electric conditioning agent.

In order to obtain a satisfactory separation by flotation, for instance, the joint use of soda ash with a surface active agent as a dispersing agent is very effective in the present invention, the same as in the prior art flotation methods. And, in order to obtain a satisfactory separation by flotation in the polycomponent system, pH regulation is important, the same as in the prior art flotation methods. Thus, in general, the flotation step itself can be carried out in accordance with conventional techniques.

The tank used for the electric conditioning step must be electrically insulated for reasons of safety of personnel and machinery and of economy in the electric power consumption. The shape of the tank is not critical. It can be circular, square, channel-shaped or tubular, for example.

Therefore, this invention comprises improving the mutual separation of the minerals by conducting d-c current into the ore slurry, prior to flotation, by means of an electrode or or electrodes to cause a depressing action, i.e., to inhibit flotation of certain minerals during the subsequent flotation step. Control or regulation of the depressing effect can be achieved simply by adjustment of the quantity of electricity applied in the conditioning step. Thus, control of the flotation operation is remarkably easy in comparison with the addition of conventional chemical agents. And also, because of the unique depressing action achieved by this invention, which hitherto has not been known, the technical field for application of this new flotation process is greatly expanded, so that minerals which are difficult to separate by the prior art methods can be effectively processed by the method of the present invention.

Moreover, since the method of the present invention has the advantageous features that the cost necessary to achieve the depressing effect is reduced and toxic agents, such as sodium cyanide, are not required, the method of the present invention makes it possible to do flotation with less pollution, and it is economical and useful in the preservation of the environment.

PREFERRED EMBODIMENTS OF THE INVENTION

In the following Examples, all "percent" refer to percent by weight.

EXAMPLE 1

The ore sample employed in this example was a zinc concentrate activated by copper sulfate, and containing iron sulfide ore and zinc sulfide ore. This sample was subjected to the method of the present invention under the following conditions, by regulating the pH to be substantially neutral and the results are shown in the Table 1.

| | |
|---|---|
| Electric conditioning agent | $CaCl_2$ 0.2 mol/l |
| Ni electrode | 48 V 1.0 $A/dm^2$ |
| Electric conditioning time | 5 min. |
| Pine oil | 50 g/t |
| KEX | 120 g/t |
| Flotation time | 7 min. |
| pH | 7.5 |

Table 1

| Kinds of minerals | Weight | Assay % | | Recovery % | |
|---|---|---|---|---|---|
| | | Zn | Fe | Zn | Fe |
| Feed | 100 | 45.3 | 15.2 | 100 | 100 |
| Zinc concentrate | 84.1 | 52.6 | 10.2 | 97.6 | 56.6 |
| Tailing | 15.9 | 6.8 | 41.4 | 2.4 | 43.4 |

Table 1 shows that the separation of Zn and Fe was done with very high efficiency by the method of this invention.

In this connection, in a comparative test the conventional flotation method for a mineral having the aforesaid composition was carried out. It was necesary to add a large amount of lime, and there was a tendency of depressing the flotation of the Zn material. The result of this conventional flotation for removal of iron from Zn concentrate containing a high amount of Fe, showed that the Zn assay in the zinc concentrate was only as high as 48percent.

EXAMPLE 2

In the flotation of molybdenum-bearing sulfide copper ore, the conventional method uses cyanides or arsenic sulfide, or phosphorus sulfide. But these depressing agents are toxic and it is not desirable to use a large amount thereof. Under the following conditions, the method of the present invention was applied to the sample and the results shown in Table 2 were obtained.

| | |
|---|---|
| Electric conditioning agent | NaCl 0.1 mol/l |
| Fe electrode | 35 V 1.0 A/dm² |
| Electric conditioning time | 1 min. |
| MIBC | 150 g/t |
| Kerosene | 50 g/t |
| Flotation time | 5 min. |
| pH | 8.5 |

Table 2

| Kinds of materials | Weight % | Assay % | | Recovery % | |
|---|---|---|---|---|---|
| | | Mo | Cu | Mo | Cu |
| Feed | 100 | 1.1 | 27.9 | 100 | 100 |
| Concentrate | 5.2 | 18.1 | 19.7 | 86.9 | 3.7 |
| Tailing | 94.8 | 0.15 | 28.4 | 13.1 | 96.3 |

Table 2 shows that Mo and Cu can be separated effectively without using any toxic agent. As compared with the prior flotation method, this method decreases greatly the number of cleanings required to obtain a final concentrate of the required concentration.

EXAMPLE 3

In the flotation of lead sulfide ore and copper sulfide ore, the conventional method uses cyanides as the depressing agent for copper sulfide ores or bichromates as the depressing agent for lead sulfide ore. But these depressing agents are toxic and it is not desirable to use a large amount thereof. Under the following conditions, the method of the present invention was applied to the sample and the results shown in the Table 3 were obtained.

| | |
|---|---|
| Electric conditioning agent | $CH_3COONa$ 0.3 mol/l |
| Al electrode | 44 V 0.8 A/dm² |
| Electric conditioning time | 2 min. |
| Pine oil | 120 g/t |
| KEX | 80 g/t |
| Flotation time | 7 min. |

Table 3

| Kinds of minerals | Weight % | Assay % | | Recovery % | |
|---|---|---|---|---|---|
| | | Pb | Cu | Pb | Cu |
| Feed | 100 | 4.5 | 24.5 | 100 | 100 |
| Concentrate | 20.8 | 15.9 | 17.7 | 73.6 | 15.0 |

Table 3-continued

| Kinds of minerals | Weight % | Assay % | | Recovery % | |
|---|---|---|---|---|---|
| | | Pb | Cu | Pb | Cu |
| Tailing | 79.2 | 1.5 | 26.3 | 26.4 | 85.0 |

EXAMPLE 4

The method of the present invention and the conventional xanthate process were both carried out on modified lead-zinc sulfide ore. The results are shown in the following table.

Table 4

| | Method of this Invention | | | | Conventional Xanthate method | | | |
|---|---|---|---|---|---|---|---|---|
| Electrical Conditioning Treatment Conditions | Aluminum electrode<br>D.C. 16 V 1.0 A/dm²<br>Electric conditioning agent<br>$CH_3COONa$<br>Electric conditioning time 10 min. | | | | None | | | |
| Flotation Conditions | Armac C 150 g/t<br>Nikko No. 10 oil 100 g/t<br>Flotation time 17 min<br>pH 8.25 | | | | $Na_2CO_3$ 2 kg/t<br>$CuSO_4$ 2 kg/t<br>Sodium amylxanthate 600g/t<br>Nikko No. 10 oil 250 g/t<br>Flotation time 17 min.<br>pH 7.8 | | | |
| | Assay % | | Recovery % | | Assay % | | Recovery % | |
| | Pb | Zn | Pb | Zn | Pb | Zn | Pb | Zn |
| Feed | 1.5 | 10.5 | 100.0 | 100.0 | 1.5 | 10.5 | 100.0 | 100.0 |
| Froth | 6.9 | 49.6 | 89.1 | 91.5 | 7.3 | 48.9 | 78.4 | 77.7 |
| Tailing | 0.2 | 1.1 | 10.1 | 8.5 | 0.4 | 2.8 | 21.6 | 22.3 |

In general, Xanthate flotation for lead-zinc ore uses $CuSo_4$ as the activator in a quantity of at most 500 g/t. However, in this Example 2 kg/t of $CuSO_4$ were required and the recovery percent is too low, and it is unprofitable. On the contrary, when the method of this invention is utilized, even if the quantity of the flotation agent is decreased, the recovery percent is improved so that it is capable of meeting industrial requirements.

The embodiments of the invention in which an exclusive property or privilege is claimed are defined as follows:

1. A method of ore separation which comprises: electrically preconditioning an ore pulp containing mixed metal sulfide ore particles selected from the group consisting of (1) mixtures of zinc sulfide and iron sulfide, (2) mixtures of molybdenum sulfide and copper sulfide, (3) mixtures of lead sulfide and copper sulfide, and (4) mixtures of lead sulfide and zinc sulfide, by applying DC current to said ore pulp from electrodes inserted in said pulp, at a current density of from 0.002 to 20 A/dm² and at a voltage of from 0.5 to 750 V, for a period of time effective to depress the flotability of iron sulfide in the case of mixture (1), copper sulfide in the case of mixtures (2) and (3), and lead sulfide in the case of mixture (4) relative to the remaining metal sulfides in the respective mixtures whereby to improve their separation characteristics; discontinuing application of said DC current; and then adding flotation agent to said electrically preconditioned pulp and subjecting said electrically preconditioned pulp to froth flotation in a flotation cell, and recovering from the flotation cell a concentrate of zinc sulfide in the case of mixture (1), molybdenum sulfide in the case of mixture (2), lead sulfide in the case of mixture (3), and zinc sulfide in the case of mixture (4).

2. The method of claim 1, in which an electric conditioning agent is added to said ore pulp prior to or during application of said DC current.

3. The method of claim 2, in which said electric conditioning agent is selected from the group consisting of KOH, NaOH, $Zn(OH)_2$, $Ca(OH)_2$, $NH_4OH$, HCl, $H_2SO_4$, $HNO_3$, $H_2C_2O_4$ and $CH_3COOH$ and salts of the latter five acids.

4. The method of claim 1, in which the material of said electrodes is selected from Al, Fe, Cu, Zn, Pb, Ni, alloys thereof and carbon, and is selected in relation to the constituent metal sulfides of said ore pulp so as to impose a substantially greater flotability depression on one of said metal sulfides than it does on another metal sulfide of said ore pulp.

5. The method of claim 1, in which said ore pulp is a mixture of zinc sulfide and iron sulfide, said electrodes are made of Ni, and a concentrate of zinc sulfide is recovered as the froth.

6. The method of claim 1, in which said ore pulp is a mixture of molybdenum sulfide and copper sulfide, said electrodes are made of Fe, and a concentrate of molybdenum sulfide is recovered as the froth.

7. The method of claim 1, in which said ore pulp is a mixture of lead sulfide and copper sulfide, said electrodes are made of Al, and a concentrate of lead sulfide is recovered as the froth.

8. The method of claim 1, in which said ore is a mixture of lead sulfide and zinc sulfide, said electrodes are made of Al, and a concentrate of zinc sulfide is recovered as the froth.

* * * * *